US006684637B2

(12) United States Patent
Beale

(10) Patent No.: US 6,684,637 B2
(45) Date of Patent: Feb. 3, 2004

(54) PARALLEL SLOT HEAT EXCHANGER

(75) Inventor: William T. Beale, Athens, OH (US)

(73) Assignee: Sunpower, Inc., Athens, OH (US)

( * ) Notice: Subject to any disclaimer, the term of this patent is extended or adjusted under 35 U.S.C. 154(b) by 0 days.

(21) Appl. No.: 10/056,833

(22) Filed: Jan. 25, 2002

(65) Prior Publication Data

US 2003/0141044 A1 Jul. 31, 2003

(51) Int. Cl.[7] ..... F02G 1/04

(52) U.S. Cl. ..... 60/526; 62/6; 165/10; 165/6

(58) Field of Search ..... 165/6, 10, 88, 165/90, 169, 170; 62/6, 430; 60/526

(56) References Cited

U.S. PATENT DOCUMENTS 1,675,829 A * 7/1928 Smith ..... 417/398
2,862,120 A * 11/1958 Onsrud ..... 310/54
3,135,319 A * 6/1964 Richards ..... 165/89
3,562,489 A * 2/1971 Lenk ..... 219/469
4,691,515 A * 9/1987 Ehrig et al. ..... 60/526
4,854,373 A * 8/1989 Williams ..... 165/46
5,746,269 A * 5/1998 Torii et al. ..... 165/10
6,131,650 A * 10/2000 North et al. ..... 165/170
6,300,693 B1 * 10/2001 Poag et al. ..... 310/54

* cited by examiner

*Primary Examiner*—Allen Flanigan
(74) *Attorney, Agent, or Firm*—Jason H. Foster; Kremblas, Foster, Phillips & Pollick

(57) ABSTRACT

A heat exchanger in which a fluid and a surface transfer thermal energy effectively with a smaller pressure drop than is conventionally realized. In a preferred embodiment, gas at one end of a piston flows into a piston chamber and passes radially through a plurality of axial slots formed through the piston sidewall and into a gap between the piston sidewall and the surface of the housing in which the piston slidably mounts. Between each pair of through-slots, longer axial slots are formed that extend only partially through the sidewall radially, and almost the entire length of the piston. Thus, around the circumference of the piston the slots alternate in structure between through-slots and longer slots. Gas that enters the gap through the through-slots flows circumferentially through the gap and into the longer slots. The gas exits the longer slots at the opposite end of the piston from the first gas space.

32 Claims, 5 Drawing Sheets

PARALLEL SLOT HEAT EXCHANGER

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO A "MICROFICHE APPENDIX"

(Not Applicable)

BACKGROUND OF THE INVENTION

1. Field of the Invention

This invention relates generally to a heat exchanger, and more particularly to a heat exchanger apparatus for transferring heat energy between a solid surface and a fluid, which includes liquids and gases.

2. Description of the Related Art

Heat exchangers that transfer heat energy from one fluid, such as a liquid, and another fluid, such as a gas, are well known. Heat exchangers are used commonly to pre-heat or pre-cool fluids in a machine. For example, a well known heat exchanger is an automobile radiator, in which liquid coolant, which has been heated by the combustion of fuel, is pumped into thin-walled passages made of thermally conductive material. Air passes over the outer surfaces of the passages, thereby removing heat during the contact between the air molecules and the outer surfaces of the passages. Thus, heat is exchanged between the liquid in the radiator and the air around the radiator.

In other mechanisms, it is desirable to transfer heat very efficiently between a fluid, such as a gas, and a solid surface. Whether the heat is then transferred to another fluid is irrelevant to the functioning of the mechanism. Within a Stirling cycle engine, for example, a displacer and a piston reciprocate to produce kinetic energy from thermal energy. The process involves the displacement of gas by a displacer within the housing of the engine between a warm end and a cool end. Conventional Stirling cycle engines have axially oriented passages that direct the gas, as the displacer displaces it, through or around the displacer. However, these axial passages do not transfer heat as efficiently as they could. Therefore, the need arises for a more effective heat transfer structure to transfer heat energy between a fluid and a solid surface.

BRIEF SUMMARY OF THE INVENTION

The invention is a heat exchanger apparatus for transferring thermal energy between a fluid and a first wall surface. The apparatus comprises a second wall having a wall surface spaced from and facing the first wall surface to form a gap between the first wall surface and the second wall surface. A first elongated slot is formed in the second wall. The first slot has an opening extending into the gap, and the first slot is in direct fluid communication with a fluid source. A second elongated slot is formed in the second wall spaced laterally from the first elongated slot. The second slot has an opening extending through the second wall surface into the gap. The second slot is in direct fluid communication with a fluid destination.

In a preferred embodiment, the apparatus comprises a second wall having an annular wall surface spaced from and facing the first wall's annular surface to form an annular gap therebetween. A first elongated slot is formed in the second wall and opens into the gap. The first slot has an axial component of orientation and is in direct fluid communication with a first fluid reservoir. A second elongated slot is formed in the second wall spaced circumferentially from the first elongated slot and opening into the gap. The second elongated slot has an axial component of orientation and is in direct fluid communication with a second fluid reservoir.

In another preferred embodiment, the apparatus comprises a second wall having a wall surface spaced from and facing the first wall surface to form a gap therebetween. A first elongated slot is formed in the second wall. The first slot opens into the gap. A second elongated slot is formed in the second wall spaced laterally from the first elongated slot. The second slot opens into the gap.

A first fluid passageway extends at least partially along the second wall and in direct fluid communication with the first slot. A second fluid passageway extends at least partially along the second wall spaced from the first circumferential passage and in direct fluid communication with the second slot.

Advantageously, the fluid flows over the wall surface, with which thermal energy is transferred, along a short, wide flow path. Causing the fluid to so flow enhances the transfer of thermal energy, because it maintains a large temperature differential between the fluid and the wall surface that is relatively constant over the entire flow path.

The invention is an arrangement of structures that provides significant advantages. It is well known that fluid film heat transfer rate is proportional to the reciprocal of the gap through which the fluid flows. It is therefore preferred to make the gap as small as the maximum permissible pressure drop will allow in order to increase heat transfer per unit area. The pressure drop is proportional to the velocity of flow of the fluid, which is reduced in the invention because the invention provides an arrangement of a plurality of parallel passages through which the fluid flows. Thus, the overall pressure drop per unit of fluid flow is much lower than for a simple axial flow annulus of the same radial gap. The ratio of pressure drops for the same heat transfer is roughly proportional to the reciprocal of number of distributed paths cubed. Therefore, for example, if the number of parallel paths in a device embodying the present invention is four, then the pressure drop is about 1/16th of the pressure drop that would exist in a simple axial flow annulus of the same total area and heat transfer.

This reduction in pressure drop results in smaller gaps and higher heat transfer rate for a given total fluid flow and pressure drop. As a result, the invention results in high heat transfer rates in small gaps without the losses normally resulting from high pressure drops. Additionally, since the fluid is immediately adjacent the wall of the device, for example the pressure wall of a Stirling cycle cryocooler, there is no need for another interface, such as between fins and a wall, and the corresponding disadvantages of brazing at the interface, which causes metallurgical problems.

Figure 1:
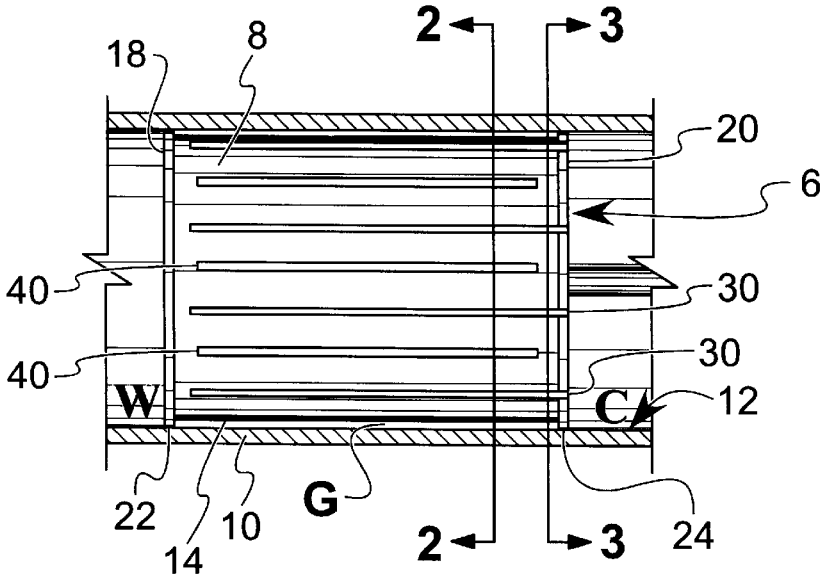
FIG. 1 is a side view in perspective illustrating a preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 2:
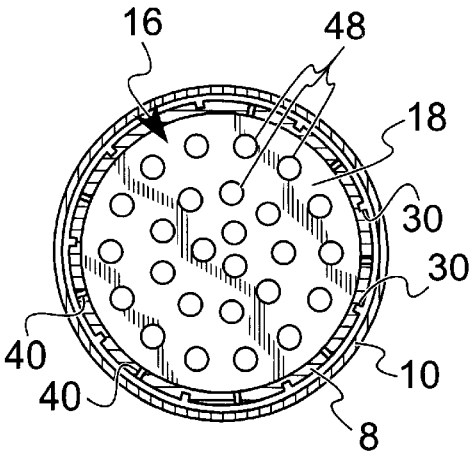
FIG. 2 is an end view in section through the line 2—2 of FIG. 1.
Figure 3:
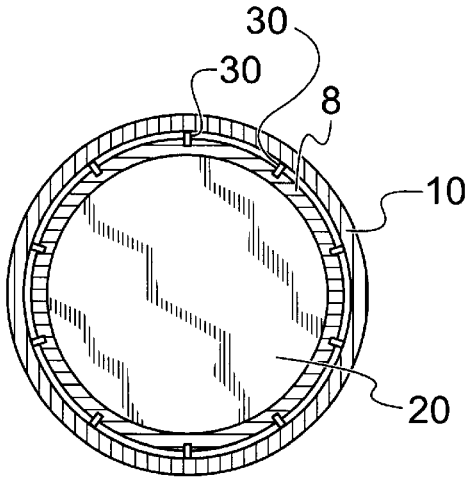
FIG. 3 is an end view in section through the line 3—3 of FIG. 1.

A preferred embodiment is shown in FIG. 1 in which a moveable piston, such as the displacer 6 of a free piston Stirling cycle engine, is slidably mounted in a housing wall 10, having an annular radially inwardly facing surface 12. Of course, there is no need to limit the invention to free piston Stirling cycle engines, because it can be used on Stirling cycle coolers, and any mechanism in which a fluid and a wall surface must exchange thermal energy efficiently. The person having ordinary skill will understand the breadth of application of the invention from the description. The displacer 6 has a circular cylindrical sidewall 8, having a radially outwardly facing surface 14. The sidewall 8 defines the radial extremes of an interior piston chamber 16, shown in FIG. 2. A pair of disk-shaped end walls 18 and 20 are mounted to opposite ends of the sidewall 8 and defining the axial ends of the chamber 16. In the preferred embodiment, the housing wall surface 12 is smooth and contiguous, because it is preferably a machined metal surface over which fluid passes to transfer heat between the surface and the fluid. However, the term "surface" includes broken and rough surfaces, including screen and mesh surfaces.

The radially outwardly facing annular surfaces 22 and 24 of the end walls 18 and 20, respectively, seat against the radially inwardly facing annular surface 12, or are at least positioned in such close proximity that the passage of gas between the annular surface 12 and the annular surfaces 22 and 24 is effectively eliminated or reduced to only a nominal amount. An annular gap, G, is formed between the inwardly facing annular surface 12 and the outwardly facing surface 12, through which gas can flow.

A plurality of a first type of slot 30 is formed in the displacer's sidewall 8. The slots 30 are oriented axially in the sidewall 8 extending from near one end of the sidewall 8 to beyond the opposite end and through the end wall 20. The slots 30 have a depth that is less than the thickness of the sidewall 8, thus precluding fluid from flowing directly into the slots 30 from the chamber 16. The slots 30 are in direct fluid communication with a gas reservoir, C, that is located at the end of the displacer on the opposite side of the end wall 20 from the chamber 16. Thus, gas in the reservoir C can flow directly into the slots 30, and vice versa.

The word "slot" includes not only elongated grooves, channels or other passages in a structure, but also includes an elongated series of closely spaced cavities or apertures that function, due to their proximity and alignment, as the slots described. It is known that even if an aperture, cavity or a plurality of these is not formed exactly like the preferred slots described herein, it can perform substantially the same if it is similar in overall size, shape and configuration. For example, a linear series of closely spaced square or circular openings through a sidewall will function similarly to the slots 30 discussed above. In some instances, the differences between the two structures may be so unimportant as to permit such a different structure to be used. Therefore, the word "slot" encompasses such similar structures.

Voids are described herein as being in direct fluid communication with, for example, a fluid chamber. This means that upon leaving the void, the fluid enters, in the example given, the fluid chamber without passing through other intermediate voids. One void is not in direct fluid communication with a second void when the fluid has to pass through yet a third void to get to the second void.

A plurality of a second type of slot 40 is formed in the displacer's sidewall 8. The slots 40 are formed axially in the sidewall 8 extending from near one end of the sidewall 8 to near the opposite end. The slots 40 have a depth equal to the sidewall's thickness. Thus, the slots 40 extend completely through the sidewall 8, thereby permitting fluid to flow directly into the slots 40 from the chamber 16 within the piston. However, the ends of the slots 40 do not extend through either end wall 18 or 20, and therefore gas cannot flow directly from the slots 40 into the reservoir C.

The term "reservoir" is used herein to refer to a source of fluid or a destination for fluid. The terms "fluid source" and "fluid reservoir" are broad terms that include not only reservoirs, but also passages, chambers, and any other voids in which gases and liquids can be contained, or through which gases and liquids can flow. A fluid source is defined as a void from which fluid flows, and a fluid destination is defined as a void to which fluid flows. Neither "source" nor "destination" is intended to indicate that the void is an ultimate source or an ultimate destination for a fluid, because fluid sources and destinations include passages through which fluid passes to get to another void.

Figure 4:
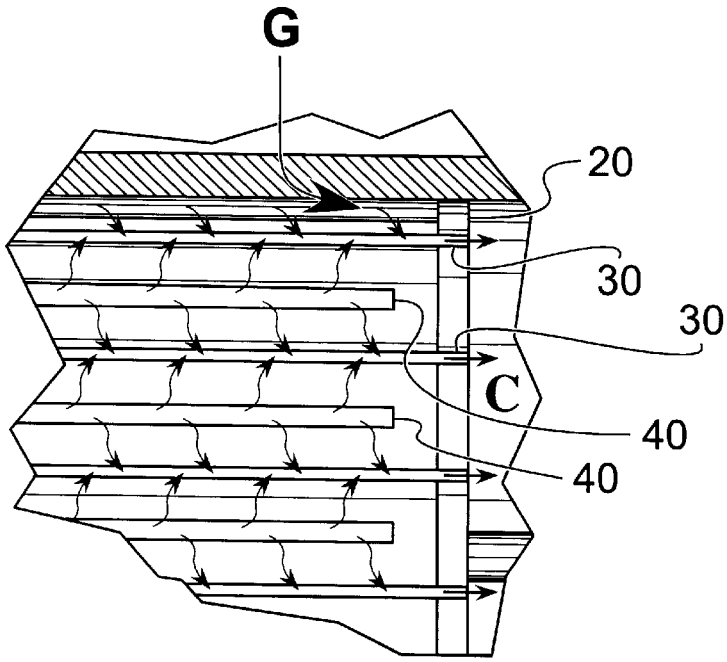
FIG. 4 is a magnified view in section illustrating the preferred embodiment.
Figure 5:
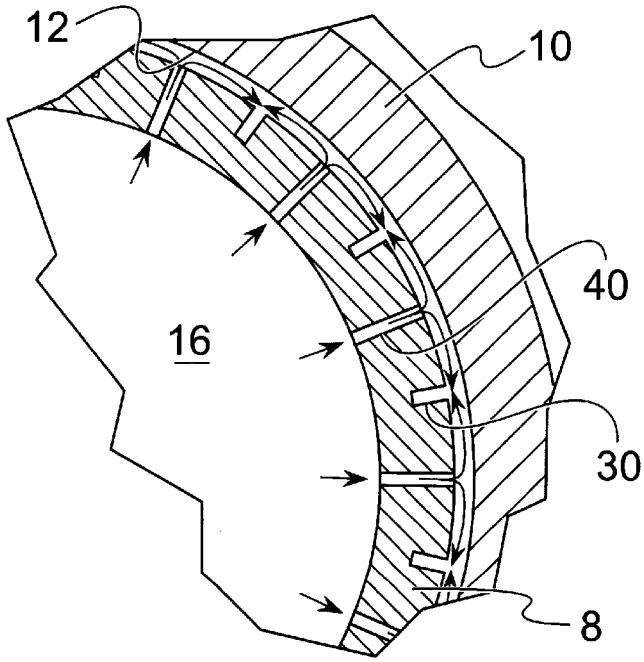
FIG. 5 is a magnified end view in section illustrating the preferred embodiment.

Gas enters and exits the chamber 16 from the reservoir, W, through apertures 48 formed in the end wall 18. Gas is forced, for example into the chamber 16, by increasing the pressure of the gas within the reservoir W and reducing, or at least keeping lower, the pressure of the gas within the reservoir C, which occurs during a portion of the Stirling cycle. When this occurs, a pressure differential exists between the two reservoirs C and W, thereby causing gas to flow into the chamber 16, through the slots 40 and into the gap G, as shown in FIGS. 4 and 5. The gas flowing into the gap G from the slots 40 flows circumferentially to the next adjacent slots 30. The gas in the slots 30 then flows axially through the slots 30 into the reservoir C. During another part of the Stirling cycle, the pressure differential reverses and the gas flows in the opposite direction.

The slots 30, gap G, slots 40, piston chamber 16 and reservoir C are all in fluid communication with one another, as gas can flow between them all. As illustrated in FIG. 5, when the gas flows circumferentially in the gap between the slots 30 and the slots 40, it passes over the radially inwardly facing surface 12, thereby transferring heat between the gas and the surface 12, assuming that a temperature differential exists. The invention therefore not only has excellent heat transfer, but because the flow distribution acts as a gas bearing, the displacer is centered, reducing wear.

Advantageously, the circumferential flow path of the gas in the instant invention is significant. The gas flow path of the invention results in excellent heat transfer between the gas and the wall surface 12. This is due, in part, to the decreased gap size that is possible due to the increased path dimensions for fluid flow over the prior art. In effect, the entire gap is used for fluid flow, rather than having a few long, narrow flow paths with greater pressure drop in each. Furthermore, because such a large surface area exists over which the fluid passes, no intermediate structures, such as fins, are necessary. The formation of fins ordinarily involves brazing to join metals, and brazing can deleteriously affect the metals that are brazed.

As the gas flows through the flow path, it exchanges heat energy with the wall and its temperature becomes closer to that of the wall. For example, a long narrow flow passage has a substantial heat transfer initially due to a higher temperature differential between the wall surface and the gas, because heat transfer rate is a function of temperature difference. However, as the gas flows farther along the flow path the temperature differential decreases due to heat transfer, thereby decreasing the efficiency of heat transfer later in the flow path. Thus, for a longer gas flow path, the gas/wall temperature difference will be smaller at the leading end of the flow path than at the trailing end. Such a long flow path has less heat transfer as compared to a flow path in which the temperature difference is large throughout.

Therefore, the shorter the flow path, the less the gas/wall temperature difference changes between the beginning and the end of the flow path. Because of the short gas flow path of the invention, the temperature difference between the gas and the wall surface 12 remains relatively constant along the flow path length. And because the gas flow path is wide, a significant amount of gas can pass through a thin gap to transfer heat efficiently between the gas and the wall surface 12 with a much lower pressure drop than with prior art structures.

The slots described in association with the embodiment above are preferably axially oriented and parallel to one another. Of course, it would be possible to form a plurality of slots that are not perfectly axially oriented, but have an axial component. The smaller the axial component, the smaller the circumferential flow advantages. Furthermore, the slots need not be exactly parallel to one another, although any differences in path length across a path's width reduce the enhancements to efficiency that would otherwise exist.

Figure 12:
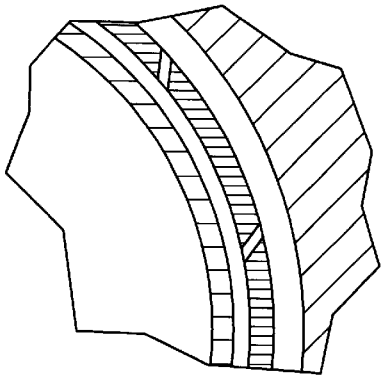
FIG. 12 is an end view in section illustrating an alternative slot shape.
Figure 13:
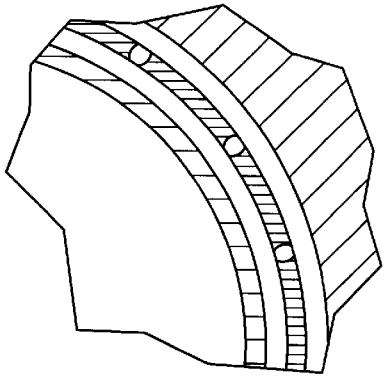
FIG. 13 is an end view in section illustrating an alternative slot shape.
Figure 14:
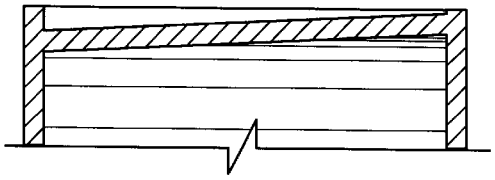
FIG. 14 is a side view in section illustrating an alternative slot shape.
Figure 15:
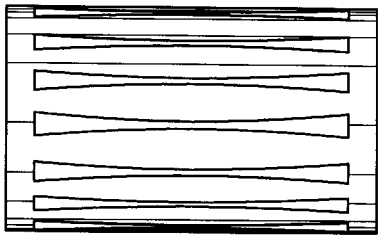
FIG. 15 is a side view in section illustrating an alternative slot shape.
Figure 16:
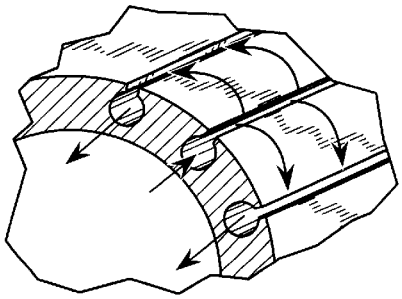
FIG. 16 is a partial end view in perspective illustrating, schematically, how fluid flows between the slots.

The shape of the slots is also important. The opposing sidewalls of the preferred slots are planar, parallel to one another and perpendicular to the surface they open into in the gap as shown in FIGS. 1 and 5. However, this is not the only possible shape and relative orientation of the slot sidewalls. For example, the slot sidewalls can be non-perpendicular, i.e., slanted, to the surface in the gap in order to induce a preferred fluid flow direction as is shown in FIG. 12. Alternatively, the sidewalls can be a shape other than planar, such as curved, to affect the flow of fluids therethrough, as shown in FIG. 13. Still further, the slots could have a shape that varies along the length, such as an "hourglass" shape as shown in FIG. 15 or an oval shape. The depth of the slots that do not extend entirely through the wall can also vary along the length of the slot as shown in FIG. 14, although a continuous depth is preferred.

The spacing between the opposed slot sidewalls, which is based on the circumstances of the application instead of being the same for all applications, in an exemplary Stirling engine embodiment is on the order of one millimeter. The thickness of the gap through which the gas flows between slots is likewise determined by the circumstances of the application, and in an exemplary embodiment is on the order of 60 microns. Variations in the dimensions will become apparent to a person of ordinary skill in the art from the description herein.

An alternative embodiment can be constructed by changing the positions of some of the structures shown in the embodiment shown in FIGS. 1 through 5. For example, the apertures 48 could be eliminated if there is no need for fluid, such as working gas in a Stirling cycle engine, to pass through a regenerator. The slots 40 are thus changed to have a depth similar to the slots 30, and extend axially through the endwall 18. This permits gas from the gas space W to flow axially into the gap through the slots 40, the gas flows circumferentially through the gap to the slots 30, and then flows axially past the opposite endwall 20 into the gas space C.

Figure 6:
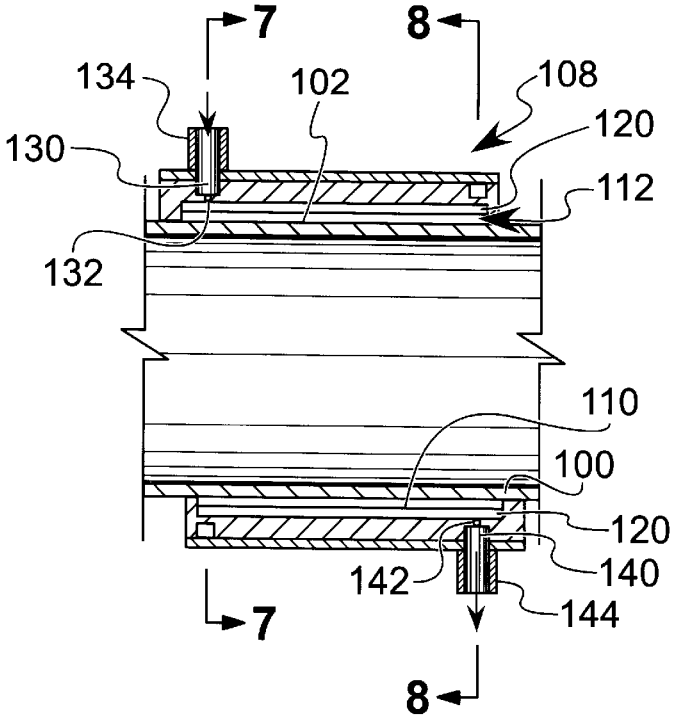
FIG. 6 is a side view in section illustrating an alternative embodiment of the present invention.

Another alternative embodiment of the present invention is shown in FIG. 6, in which a wall 100 has a radially outwardly facing annular surface 102. A jacket 108, having a radially inwardly facing annular surface 110, is mounted to the outwardly facing surface 102, forming an annular gap 112 therebetween. The jacket 108 can be used, for example, at a cool end or a warm end, of a free piston Stirling cycle machine. Thus, the embodiment transfers heat between the wall 100 and a fluid flowing as described below.

A plurality of parallel, axial slots 120 is formed in the inwardly facing surface 110 of the jacket 108. The slots 120 extend substantially the length of the gap 112 and are spaced circumferentially around the surface 110. A first annular groove 130 is formed in the jacket 108 near one end of the gap 112, and provides a fluid flow path that is not appreciably restrictive to the flow of fluid. The annular groove 130 is in fluid communication with every other one of the slots 120 by the apertures 132 formed in the bottom of the annular groove 130 where the annular groove 130 intersects each of the slots 120 near their axial end.

A second annular groove 140 is formed in the jacket 108 near the opposite end of the gap 112 from the annular groove 130, and provides a fluid flow path that is not appreciably restrictive to the flow of fluid. The annular groove 140 is in fluid communication with the slots 120 that do not have apertures 132 therein, by the apertures 142 formed in the bottom of the annular groove 140 where the annular groove 140 intersects the opposite ends of the slots 120.

Figure 7:
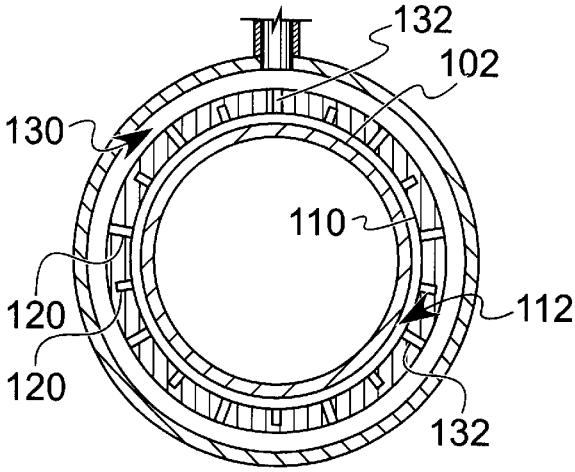
FIG. 7 is an end view in section along the line 7—7 of FIG. 6.
Figure 8:
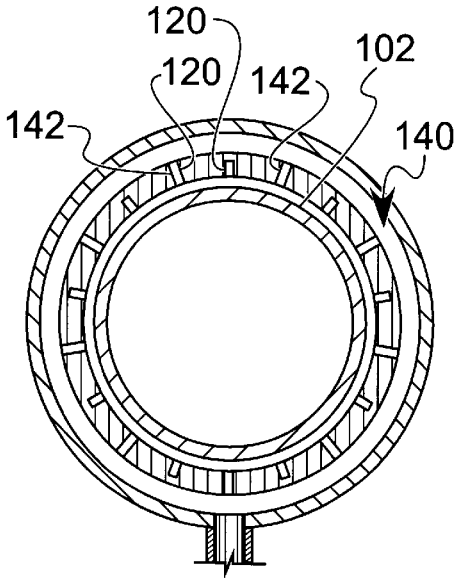
FIG. 8 is an end view in section along the line 8—8 of FIG. 6.

During the operation of the embodiment shown in FIGS. 6 through 8, there is a pressure differential between the fluid in the manifold 134 and the manifold 135. Thus, fluid, such as gaseous oxygen flows from the manifold 134 into the annular groove 130, and from the annular groove 130 flows into every other slot 120 through the apertures 132. The gas in this first set of slots 120 flows into the gap 112 toward the next adjacent slots 120 having apertures 142 at their opposite ends. The gas in the second set of slots 120 flows axially along the slots toward the apertures 142, through the apertures 142 into the annular groove 140 and from the annular groove 140 into the manifold 135. In one contemplated embodiment, the gas condenses due to removal of heat therefrom, thereby resulting in a gas entering the manifold 134 and a liquid exiting the manifold 135.

As with the preferred embodiment described above, the gas flowing between slots 120 in the embodiment of FIGS. 6 through 8 traverses a short wide flow path and thermal energy is transferred between the fluid and the wall 100 very effectively with a smaller pressure drop than is conventionally possible. The direction of gas flow can be reversed from that described, if desired.

The embodiment described in association with FIGS. 6 through 8 can be changed and still embody the concept of the present invention. For example, if it is desired for the jacket 108 to be on the inside of the wall 100, a person of ordinary skill reading the instant description can, using ordinary mechanical principles, make a new jacket that seats against the inside of a wall, thereby performing a similar function to that shown. Alternatively, the annular grooves 130 and 140 of the FIG. 6 embodiment can be replaced by a structure in which every other slot 120 axially extends past the endwall into a manifold or other fluid passage mounted to the jacket. In such an embodiment, every other slot 120 extends axially in the opposite direction to a second manifold or other fluid passage. Thus, fluid would first flow into the first manifold, which is connected to every other slot. The gas would flow into those slots, through the circumferential gap to the other slots, and then axially into the second manifold at the opposite axial end.

Figure 9:
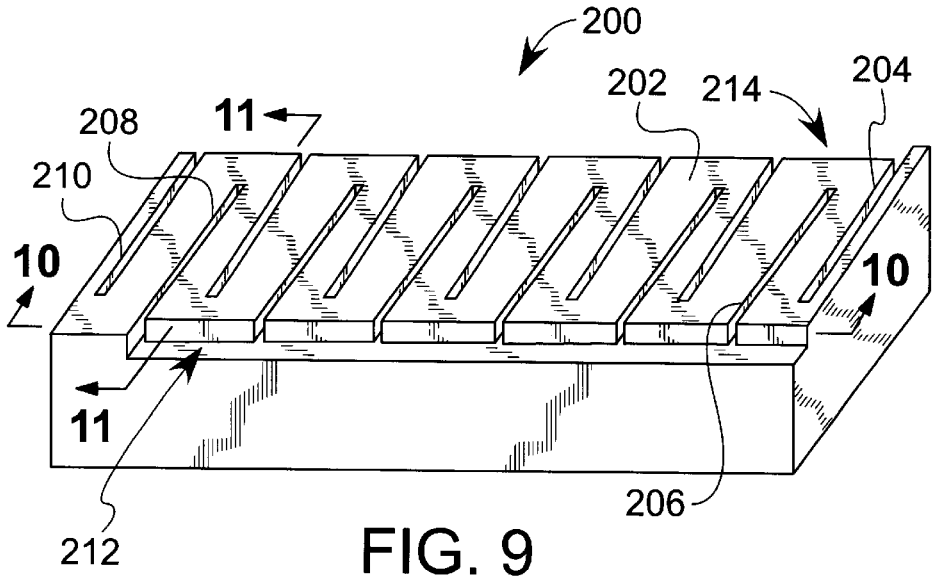
FIG. 9 is a view in perspective illustrating a component of an alternative embodiment of the present invention.

The principles taught above are applicable to virtually any structure in which a gas and a solid surface exchange heat energy whether in a cylindrical device or a planar device. The embodiment illustrated in FIG. 9 includes a planar block 200 having a plurality of slots formed in an upper surface 202 thereof. The slots 204, 206, 208 and 210 are representative, and will be discussed with the understanding that the other similar slots in the surface 202 function essentially identically thereto.

Figure 10:
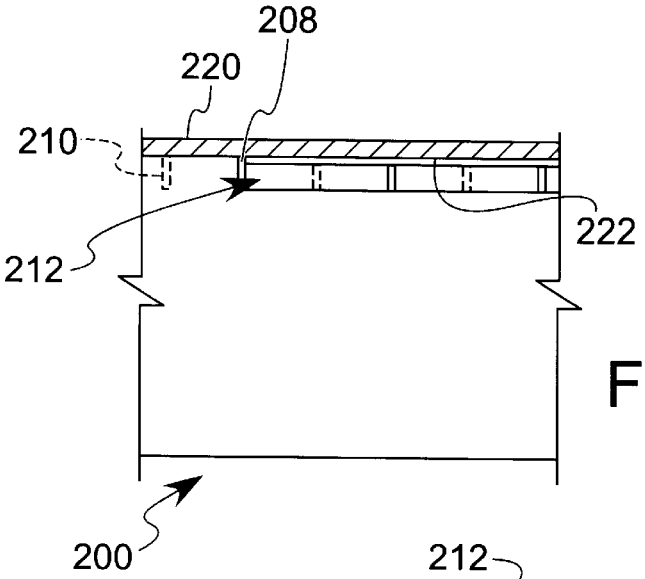
FIG. 10 is a side view in section along the line 10—10 of FIG. 9.
Figure 11:
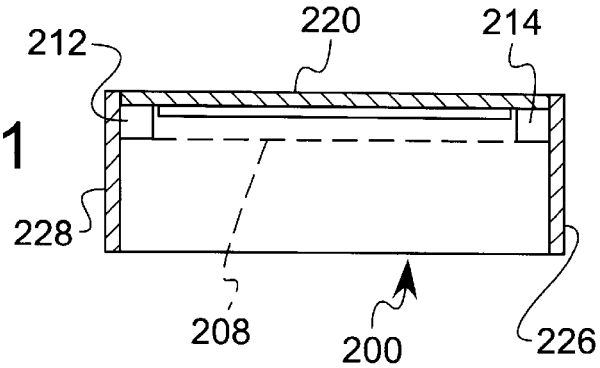
FIG. 11 is a side view in section along the line 11—11 of FIG. 9.

The slots 206 and 208 extend into the surface 202 from a front elongated passage 212 that produces only a small resistance to the flow of gas, and end near an opposite edge of the block 200. The slots 204 and 210 extend into the surface 202 from a rear elongated passage 214 that produces only a small resistance to the flow of gas, and end near the opposite edge of the block 200 near the passage 212. A plate 220 (see FIG. 10) having a planar surface 222 is disposed across the top of the block 200 spaced in close proximity to the surface 202 to form a gap between the surface 202 and the planar surface 222. Other plates 226 and 228 (see FIG. 11) are mounted across the front and rear of the block 200 to enclose the passages 212 and 214. At opposite longitudinal ends, passages 212 and 214 are open to receive fluid tubing that conveys fluid, such as gas, to and from the passages 212 and 214.

When gas is, for example, at a higher pressure in the passage 212 than the passage 214, gas flows into the slots 206, 208 and the slots similarly connected to the passage 212. That gas flows into the gap between the surfaces 202 and 222 from the slots 206 and 208 and flows from the gap into the parallel slots 204 and 210 and the slots similarly connected to the passage 214. The gas then flows from the slots 204 and 210 into the passage 214 and out of the heat exchanger apparatus. The gas and the surface 222 exchange heat energy as the gas flows through the short, wide gas flow path in the gap between the surfaces 202 and 222.

While certain preferred embodiments of the present invention have been disclosed in detail, it is to be understood that various modifications may be adopted without departing from the spirit of the invention or scope of the following claims.

What is claimed is:

1. A heat exchanger apparatus for transferring thermal energy between a fluid and a first wall surface, the apparatus comprising:

(a) a wall having a wall surface spaced from and facing the first wall surface forming an occupied fluid gap between the first wall surface and the second wall surface;

(b) a first elongated slot formed in the second wall surface, the first slot opening into the unoccupied fluid gap and being in direct fluid communication with a fluid source; and (c) a second elongated slot formed in the second wall surface and spaced laterally from the first elongated slot, the second slot opening into the unoccupied fluid gap and being in direct fluid communication with a fluid destination.

2. The apparatus in accordance with claim 1, wherein the first and second slots have axial components of orientation, the fluid source is a first fluid reservoir, and the fluid destination is a second fluid reservoir.

3. A heat exchanger apparatus for transferring thermal energy between a fluid and a first wall surface, the apparatus comprising:

(a) a second wall having wall surface spaced from and facing the first wall surface forming a gap between the first wall surface and the second wall surface;

(b) a first elongated slot formed in the second wall surface, the first slot opening into the gap and being in direct fluid communication with a fluid source; and (c) a second elongated slot formed in the second wall surface and spaced laterally from the first elongated slot, the second slot opening into the gap and being in direct fluid communication with a fluid destination:

wherein the first and second slots have axial components of orientation, the fluid source is a first fluid reservoir, the fluid destination is a second fluid reservoir, the first and second wall surfaces are annular, and the gap is an annular gap formed therebetween.

4. The apparatus in accordance with claim 3, wherein the first and second slots are substantially axially oriented and substantially parallel to one another.

5. The apparatus in accordance with claim 4, further comprising third and fourth axially oriented slots formed in the second wall surface and opening into the gap, the third slot being formed adjacent and substantially parallel to the second slot and spaced circumferentially therefrom, and the fourth slot being formed between and substantially parallel to the first and third slots and spaced circumferentially therefrom, wherein the third slot is in direct fluid communication with the first fluid reservoir, and the fourth slot is in direct fluid communication with the second fluid reservoir.

6. The apparatus in accordance with claim 5, wherein the second fluid reservoir is a fluid space on one axial end of the piston, and the fluid space communicates with the second and fourth slots through openings at axial ends of the second and fourth slots.

7. The apparatus in accordance with claim 5, wherein the first fluid reservoir is a chamber within the piston, and the chamber communicates with the first and third slots through openings into the first and third slots on an opposite side of the first and third slots into the gap.

8. The apparatus in accordance with claim 7, wherein the second fluid reservoir is a fluid space on one axial end of the piston, and the fluid space communicates with the second and fourth slots through openings at axial ends of the second and fourth slots.

9. The apparatus in accordance with claim 8, wherein the fluid is a gas.

10. The apparatus in accordance with claim 9, wherein the first and second walls are slidably moveable relative to each other.

11. The apparatus in accordance with claim 1, wherein the fluid source is a first fluid passageway extending along the second wall and in direct fluid communication with the first slot, and the fluid destination is a second fluid passageway extending along the second wall spaced from the first circumferential passage and in direct fluid communication with the second slot.

12. The apparatus in accordance with claim 11, wherein the first and second wall surfaces are annular, and the gap is an annular gap formed therebetween.

13. The apparatus in accordance with claim 12, wherein the second fluid passageway comprises a second circumferential, annular groove extending around the second wall on an opposite side of the second wall from the second slot, the second groove having at least one fluid aperture extending through the second wall into the second slot.

14. The apparatus in accordance with claim 12, wherein the first fluid passageway comprises a first circumferential, annular groove extending around the second wall on an opposite side of the second wall from the first slot, the first groove having at least one fluid aperture extending through the second wall into the first slot.

15. The apparatus in accordance with claim 14, wherein the second fluid passageway comprises a second circumferential, annular groove extending around the second wall on an opposite side of the second wall from the second slot, and spaced from the first groove a distance substantially equal to the length of the first slot, the second groove having at least one fluid aperture extending through the second wall into the second slot.

16. The apparatus in accordance with claim 15, wherein the first and second slots are substantially axially oriented and substantially parallel to one another.

17. The apparatus in accordance with claim 16, further comprising third and fourth axially oriented slots formed in the second wall surface and opening into the gap, the third slot being formed adjacent and substantially parallel to the second slot and spaced circumferentially therefrom, and the fourth slot being formed between and substantially parallel to the first and third slots and spaced circumferentially therefrom, wherein at least one fluid aperture extends from the third slot through the second wall into the first groove, and at least one fluid aperture extends from the fourth slot through the second wall into the second groove.

18. The apparatus in accordance with claim 17, further comprising a first fluid manifold mounted to the second wall and in fluid communication with the first groove, and a second fluid manifold mounted to the second wall and in fluid communication with the second groove.

19. The apparatus in accordance with claim 18, wherein the fluid is a gas.

20. A heat exchanger apparatus for transferring thermal energy between a fluid and a first wall surface, the apparatus comprising:

(a) a second wall having a wall surface spaced from and facing the first wall surface to form a fluid gap between the first wall surface and the second wall surface;

(b) a first elongated slot formed in the second wall surface and opening into the fluid gap, the first slot having an axial component of orientation and being in direct fluid communication with a first fluid reservoir; and (c) a second elongated slot formed in the second wall surface spaced circumferentially from the first elongated slot and opening into the fluid gap, the second elongated slot having an axial component of orientation and being in direct fluid communication with a second fluid reservoir.

21. A heat exchanger apparatus for transferring thermal energy between a fluid and a first wall surface, the apparatus comprising:

(a) a second wall having a wall surface spaced from and facing the first wall surface to form a gap between the first wall surface and the second wall surface;

(b) a first elongated slot formed in the second wall surface and opening into the gap, the first slot having an axial component of orientation and being in direct fluid communication with a first fluid reservoir; and (c) a second elongated slot fanned in the second wall surface spaced circumferentially from the first elongated slot and opening into the gap, the second elongated slot having an axial component of orientation and being in direct fluid communication with a second fluid reservoir, wherein the first and second wall surfaces are annular, and the gap is an annular gap fanned therebetween.

22. The apparatus in accordance with claim 21, wherein the first and second slots are substantially axially oriented and substantially parallel to one another.

23. The apparatus in accordance with claim 22, further comprising third and fourth axially oriented slots formed in the second wall surface and opening into the gap, the third slot being formed adjacent and substantially parallel to the second slot and spaced circumferentially therefrom, and the fourth slot being formed between and substantially parallel to the first and third slots and spaced circumferentially therefrom, wherein the third slot is in direct fluid communication with the first fluid reservoir, and the fourth slot is in direct fluid communication with the second fluid reservoir.

24. The apparatus in accordance with claim 23, wherein the second fluid reservoir is a fluid space on one axial end of the piston, and the fluid space communicates with the second and fourth slots through openings at axial ends of the second and fourth slots.

25. The apparatus in accordance with claim 23, wherein the first fluid reservoir is a chamber within the piston, and the chamber communicates with the first and third slots through openings into the first and third slots on an opposite side of the first and third slots into the gap.

26. The apparatus in accordance with claim 25, wherein the second fluid reservoir is a fluid space on one axial end of the piston, and the fluid space communicates with the second and fourth slots through openings at axial ends of the second and fourth slots.

27. The apparatus in accordance with claim 26, wherein the fluid is a gas.

28. The apparatus in accordance with claim 27, wherein the first and second walls are slidably moveable relative to each other.

29. A heat exchanger apparatus for transferring thermal energy between a gas and a housing, the housing having a circular cylindrical surface in which a piston is slidably mounted, the piston having a hollow cylindrical sidewall and first and second endwalls mounted to opposite ends of the sidewall defining a piston chamber within the piston sidewall and endwalls, said first and second endwalls defining first and second gas spaces, respectively, on opposite ends of the piston, and an annular gap formed between the housing surface and the sidewall, the heat exchanger apparatus comprising:

(a) at least one gas passageway formed through the first endwall forming a gas flow passage between the first gas space and the piston chamber;

(b) a first slot formed in a radially outwardly facing surface of the sidewall, said first slot having an axial component and a depth equal to a piston sidewall thickness forming a gas flow path between the piston chamber and the annular gap, the first slot extending along the piston sidewall from near the first endwall to near the second endwall;

(c) a second slot formed in the radially outwardly facing surface of the sidewall spaced from the first slot and substantially parallel thereto, the second slot having an axial component and a depth less than the piston sidewall thickness, the second slot extending along the piston sidewall from near the first endwall to and through the second endwall forming a gas flow path between the annular gap and the second gas space;

(d) a third slot formed in the radially outwardly facing surface of the sidewall spaced from the second slot and substantially parallel thereto, said third slot having an axial component and a depth equal to the piston sidewall thickness forming a gas flow path between the piston chamber and the annular gap, the third slot extending along the piston sidewall from near the first endwall to near the second endwall; and (e) a fourth slot formed in the radially outwardly facing surface of the sidewall spaced from the first and third slots and substantially parallel thereto, the fourth slot having an axial component and a depth less than the piston sidewall thickness, the fourth slot extending along the piston sidewall from near the first endwall to and through the second endwall forming a gas flow path between the annular gap and the second gas space.

30. The apparatus in accordance with claim 29, further comprising a thermal regenerator mounted in the piston chamber.

31. The apparatus in accordance with claim 29, wherein the first, second, third and fourth slots are substantially axially oriented.

32. The apparatus in accordance with claim 31, wherein each slot has a continuous depth along its length and has substantially parallel, planar slot sidewalls.

* * * * *

UNITED STATES PATENT AND TRADEMARK OFFICE

CERTIFICATE OF CORRECTION

PATENT NO. : 6,684,637 B2
DATED : February 3, 2004
INVENTOR(S) : William T. Beale It is certified that error appears in the above-identified patent and that said Letters Patent is hereby corrected as shown below:

Column 8,
Line 19, add -- second -- between "a" and "wall".
Line 20, delete "occupied" and insert therefor -- unoccupied --.

Column 10,
Line 9, delete "a" and insert therefor -- an unoccupied --.
Lines 13 and 18, after "the" (first occurence) insert -- unoccupied --.
Lines 32 and 38, delete "fanned" and insert therefor -- formed --.

Signed and Sealed this

First Day of November, 2005

JON W. DUDAS
*Director of the United States Patent and Trademark Office*